US007862161B2

(12) United States Patent
Ogle et al.

(10) Patent No.: US 7,862,161 B2
(45) Date of Patent: Jan. 4, 2011

(54) INK DETECTOR VIEWABLE WITH THE HUMAN EYE

(75) Inventors: Holli C. Ogle, Corvallis, OR (US); Ralph L. Stathem, Lebanon, OR (US); Marc A. Baldwin, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 629 days.

(21) Appl. No.: 11/927,125

(22) Filed: Oct. 29, 2007

(65) Prior Publication Data

US 2009/0109252 A1 Apr. 30, 2009

(51) Int. Cl.
*B41J 2/17* (2006.01)

(52) U.S. Cl. ..... 347/84; 347/86; 347/7

(58) Field of Classification Search ..... 347/84, 347/86, 7

See application file for complete search history.

(56) References Cited

U.S. PATENT DOCUMENTS

| | | | | |
|---|---|---|---|---|
| 5,616,929 | A | 4/1997 | Hara | |
| 6,274,880 | B1 * | 8/2001 | Walker | 250/577 |
| 6,422,675 | B1 | 7/2002 | Tomomatsu | |
| 7,040,728 | B2 | 5/2006 | Merz et al. | |
| 7,055,926 | B2 * | 6/2006 | Kojima et al. | 347/19 |
| 7,213,914 | B2 | 5/2007 | Anma et al. | |
| 2001/0035887 | A1 * | 11/2001 | Altfather et al. | 347/7 |
| 2006/0001684 | A1 | 1/2006 | Papaiacovou et al. | |
| 2010/0208015 | A1 * | 8/2010 | Matsumoto et al. | 347/86 |

FOREIGN PATENT DOCUMENTS

| | | | |
|---|---|---|---|
| JP | 7311072 | A | 11/1995 |
| JP | 2000-071470 | A | 3/2000 |
| JP | 2005-313446 | A | 11/2005 |

OTHER PUBLICATIONS

International Search Report. Mailing Date Apr. 29, 2009. International application No. PCT/US2008/081265. Filing date Oct. 27, 2008.

Http://encyclopedia.thefreedictionary.com/p/Fresnel+equations.

* cited by examiner

*Primary Examiner*—Ellen Kim

(57) ABSTRACT

An ink cartridge configured to hold an ink includes a substantially hollow body including an inner space and a substantially continuous inner wall. The cartridge further includes an optical prism in the inner space, disposed at a predetermined distance from the continuous inner wall such that an ink pocket is defined by a prism wall and the continuous inner wall. The prism includes at least one reflection site formed at an angle configured to reflect light from a light source through the prism at a predetermined height relative to a bottom of the body. If ink is present in the ink pocket at a level below at least a portion of the reflection site, the ink does not block the light reflected off of the portion of the reflection site from traveling across the ink pocket at the predetermined height, such that the reflected light is externally viewable.

22 Claims, 4 Drawing Sheets

INK DETECTOR VIEWABLE WITH THE HUMAN EYE

BACKGROUND

Previous attempts have been made to render customer viewable the amount of ink in an ink cartridge of an inkjet printer. Other attempts have been made to manufacture and implement a dependable electrical ink supply detection mechanism that informs customers, for example, via their computer screen or an electrical signal sent to their printer, when their cartridges are almost out of ink.

Attempts have been made using light beams reflected or refracted by prisms to produce both a customer viewable and electrically detectable means of ink supply detection. Furthermore, a prism structure has been positioned in an ink cartridge for purposes of ink level detection.

A principle of optics, called Total Internal Reflection (TIR), is relevant to this discussion of light beams and prisms. TIR occurs when an internal light ray strikes an internal segment of the prism at an angle greater than a certain critical angle with respect to an angle normal to the light beam and the internal segment. If the light beam hits the prism segment at or greater than the certain critical angle, and if the refractive index is lower on the outside than on the inside of the prism, such as when the prism is surrounded by air, no light at the critical angle or above can pass through to the outside of the prism. In that case, all of the light is reflected within the prism. Given the materials from which prisms are usually made (e.g., glass or polymeric materials), the critical angle for such prisms are usually between the angles of 40 and 50 degrees.

Previous attempts to utilize light and prisms with an ink cartridge to produce readable light signals related to ink level in the ink cartridge tend to produce signals which are unclear, from either an electrical detection or a human viewable perspective. The on/off signal produced is generally not strong.

BRIEF DESCRIPTION OF THE DRAWINGS

Features and advantages of embodiments of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

Embodiments of the ink cartridge disclosed herein allow a customer to view, with a glance at his/her printer or with an equivalent electronic means, the amount of ink remaining in the particular ink cartridge. This is achieved by positioning a light-emitting diode (LED) or other comparable light source in, on or near the ink cartridge, such that the light beam from the light source is able to reach a designated place inside of the ink cartridge. In one non-limiting example, the light source is placed just outside a bottom portion of the ink cartridge. The ink cartridge itself advantageously contains at least one optical prism through which a light signal is accurately beamed to a viewing window open to a user's eye and/or to an electrical detector which is configured to register the light signal. Based on the level of ink in the ink cartridge, various light signals may be produced.

Figure 1:
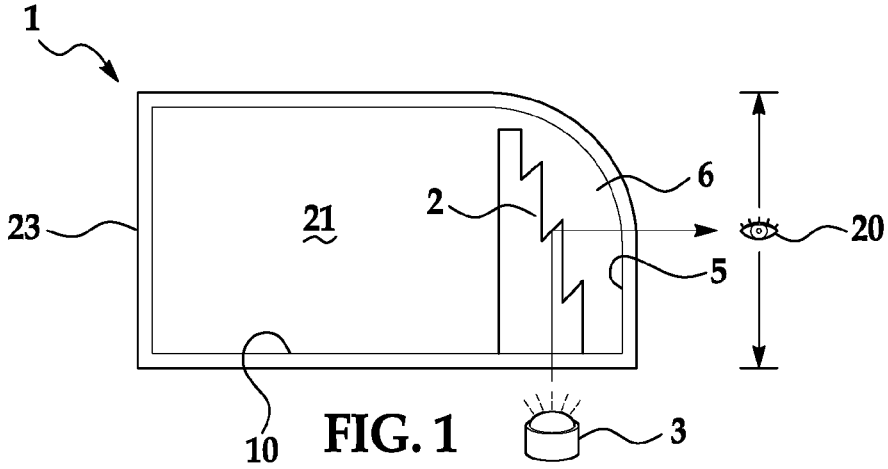
FIG. 1 depicts a semi-schematic view of an embodiment of an ink cartridge.

FIG. 1 shows an ink cartridge 1 formed of a substantially hollow body 23 with an LED 3 positioned below the lower right corner. It is to be understood that the LED 3 is generally positioned such that light from the LED 3 travels upward through the cartridge 1 and into a prism 2 operatively positioned within an inner space 21 of the substantially hollow body 23 of the ink cartridge 1. In some non-limiting embodiments, the prism 2 is attached to the bottom side 10 of the ink cartridge inner space 21. Embodiments of the prism 2 are generally smaller than both the length and width of the inner space 21 of the ink cartridge 1. This allows ink to flow freely back and forth around the prism 2 in the ink cartridge inner space 21, including in the ink pocket 6, which is a space formed between the prism 2 and the adjacent inner wall 5 of the cartridge 1.

The light is reflected off of the optical prism 2 at a predetermined reflection angle formed on the prism 2 at specific reflection sites 4. The reflection angle(s) are often formed by cutting prism material in angular cut-outs on the surface thereof. In one embodiment, the predetermined reflection angle is 45°; and in another embodiment, the angle ranges from approximately 40° to 50°, depending, at least in part, on the material of the prism 2.

The light beam reflected from the prism 2 is directed out of the cartridge 1 approximately perpendicularly to the original direction of the light beam. In some instances, the inner wall 5 of the cartridge 1 is substantially vertical (i.e., at least a portion of the inner wall 5 is vertical) and parallel to the original light beam, and as such, the reflected light beam is horizontal with respect to the vertical inner wall 5 of the cartridge 1. However, depending on the angle of incidence with the reflection site 4, it is possible for the light to travel out of the cartridge 1 in a direction other than horizontal. It is also possible for the light to bounce around the prism 2 and the ink cartridge 1 before it exits the cartridge 1 through the appropriate area. This light beam directed from the reflection site 4 out of the cartridge 1 is then viewable by a user's eye 20 or detectable by a detector 16 (shown in FIGS. 7A though 7E) through a window 7 in the printer 8 (shown in FIG. 4), the window 7 being adjacent to the inner wall 5 of the cartridge 1.

Figure 2A:
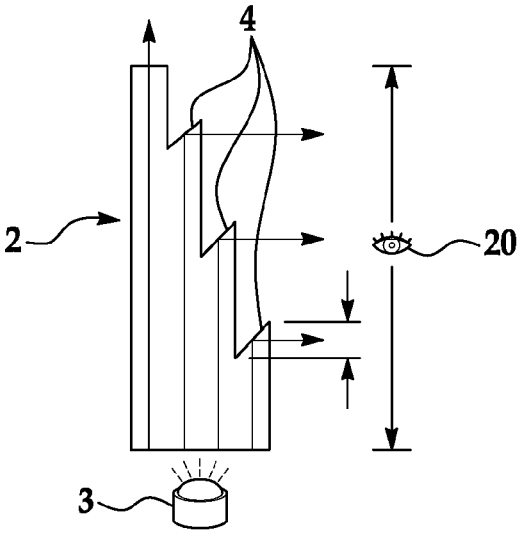
FIG. 2A depicts a semi-schematic view of an embodiment of an optical prism.
Figure 2B:
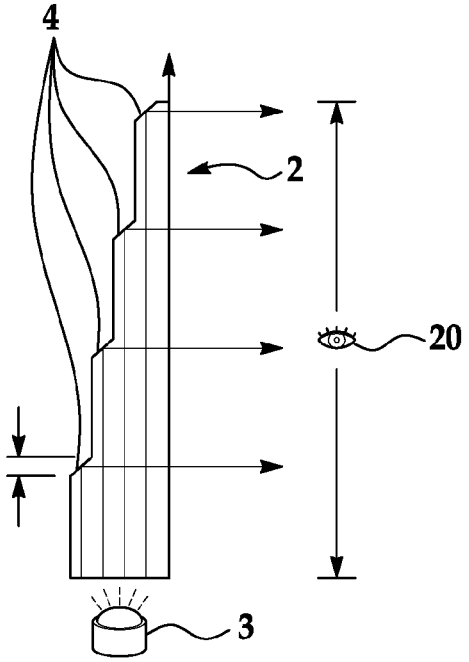
FIG. 2B depicts a semi-schematic view of another embodiment of an optical prism.

FIGS. 2A and 2B show embodiments of two different prisms 2 with several reflection sites 4 on each prism 2, and with each reflection site 4 formed at substantially the same angle (e.g., 45°) in relation to the prism 2. FIG. 2A shows an embodiment with reflection sites 4 formed by jagged cut-outs on the ink pocket 6 side of the prism 2. FIG. 2B shows another embodiment with reflection sites 4 formed by a series of 45° angle steps on the wall of the prism 2 opposite the ink pocket 6.

Figure 3:
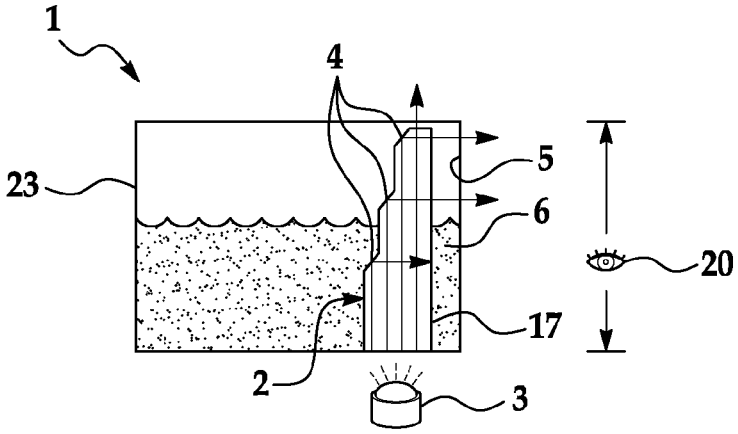
FIG. 3 depicts a semi-schematic view of an embodiment of ink cartridge having ink therein.

FIG. 3 shows an embodiment in which an optical prism 2 is positioned inside an ink cartridge 1 that is partially filled with ink. This embodiment of the prism 2 includes three approximately 45° angle reflection sites 4 cut out on the side of the prism 2 opposite the ink pocket 6. The LED 3 is positioned below the ink cartridge 1 and directly below the prism 2 such that the LED 3 light shines upward and hits the three reflection sites 4. The three 45° cut-out reflection sites 4 in turn reflect three separate light beams at an angle of about 90° to the direction of the original upward light beam from the LED 3. The three light beams from the three reflection sites 4 pass horizontally, or near horizontally, across the prism 2 to the ink pocket 6 side of the prism 2. As shown in FIG. 3, the ink in the ink cartridge 1 is at a level which reaches above the lowest of the three reflection sites 4 and its corresponding light beam. Thus the lowest of the three light beams is blocked by the ink in the ink pocket 6, and thus is not viewable through the viewing window(s) 7 of the printer 8 (shown in FIG. 4). The other two beams, which are not blocked by ink in the ink pocket 6, pass across the ink pocket 6 and shine through the inner wall 5 of the ink cartridge 1 and through the viewing window(s) 7 of the printer 8, such that eyes 20 of viewers and/or detectors may perceive them.

It is believed that the light travels from the LED 3 through the prism 2 and out of the cartridge 1 according to the principle of Total Internal Reflection (TIR), and the fact that light rays travel through ink with difficulty or not at all. According to the TIR principle, the interface between the ink and the prism 2 (at the predetermined angle) and the interface between the air and the prism 2 reflect/refract the light differently. Furthermore, if the ink pocket 6, located between a vertical prism wall 17 and the most nearly adjacent cartridge wall 5, contains ink at a level below a reflection site 4, light travels from that reflection site 4, out the prism 2, and through the cartridge wall 5 and viewing window 7. When the light beam from the prism 2 interfaces with air as it exits the prism 2 into the ink pocket 6, it travels essentially unrefracted through the air and hits the inner wall 5 of the ink cartridge 1 at an angle perpendicular to the original light beam (e.g., if the reflection site 4 is about 45°), thus passing through the viewing window 7.

If the ink pocket 6 between the prism 2 and the ink cartridge wall 5 is filled with ink to a level above one of the reflection sites 4 in the prism 2, the light reflected from that reflection site 4 is substantially blocked by the ink. This prevents the light from traveling across the ink pocket 6 to the ink cartridge wall 5. As such, when enough ink is present to fill the ink pocket 6 to the level of a given reflection site 4, the light from the given reflection site 4 never reaches the viewing window 7. For example, when the ink container 1 is filled with pigment-based ink to the level shown in FIG. 3, the lights from the two top reflection sites 4 on the prism 2 will shine through the viewing window 7, while the light from the lowest reflection site 4 will be lost in the ink. It is to be understood, however, that when the ink present in the cartridge 1 is dye-based ink, it is possible for some faint amount of light to reach the viewing window 7 from even those reflection sites 4 located at or below the ink level.

It is to be understood that if the ink level in the ink pocket 6 is above a portion of the reflection site 4 and not the entire reflection site 4, a light signal may be reflected from the portion of the reflection site 4 that is above the ink level. Such a light signal is weaker than a light signal generated from a reflection site entirely above the ink level.

Therefore, the phenomenon of effectively generating light signals for detection of ink level in embodiments of the ink cartridge 1 disclosed herein is made possible both by the principals of TIR, which governs how the light is reflected by the reflection sites 4 within the prism 2, and also by the fact that the light beamed from the prism 2 can be blocked substantially completely with ink. As previously described, when ink is present in the ink cartridge 1 at a level which blocks a given reflection site 4, the light is prevented from beaming out of the prism 2. But, when ink is not present in the ink cartridge 1 at a level which blocks at least a portion of the reflection site 4, at least a portion of the light beams out of the prism 2 and a detectable and/or visible signal is generated.

More specifically, the light beams are reflected from the respective reflection sites 4 to the interface between the vertical prism wall 17 and the ink pocket 6. When an area of the vertical prism wall 17 directly opposite a reflection site 4 is blocked by ink present in the ink pocket 6 (e.g., the ink pocket is relatively full of ink), the light beam from that reflection site 4 is not able to beam from the vertical prism wall 17 through the ink pocket 6 and out of the ink cartridge 1. In contrast, when the interface is not covered or blocked by ink present in the ink pocket 6 (e.g., the ink pocket 6 is relatively empty of ink), the light beam from that reflection site 4 is able to beam from the prism 2 through the ink pocket 6 and out of the ink cartridge 1.

As the ink cartridge 1 is used, the ink level reduces within the ink cartridge 1, thereby exposing additional reflection sites 4 and those areas of the vertical prism wall 17 directly opposite those reflection sites 4. As the ink level in the ink pocket 6 becomes further depleted and additional reflection sites 4 become exposed above the ink level, individual light bands (corresponding to the exposed reflection site 4) continue to "turn on" and are sequentially added and shown on a visual display, thereby providing a countdown to when the ink supply in the cartridge 1 is used up.

Figure 4:
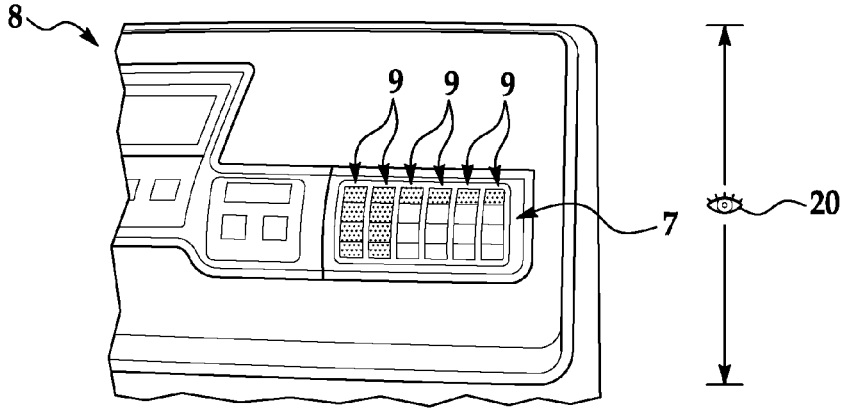
FIG. 4 depicts a semi-schematic cutaway view of a portion of an embodiment of a printer.

Referring now to FIG. 4, a user inserts a filled ink cartridge 1 into a printer 8. If the ink cartridge 1 is loaded properly, a supply light may illuminate at the top of the unlit vertical light string 9 in the viewing window 7 of the printer 8 to indicate proper installation of the ink cartridge 1. According to the pattern shown in FIG. 4, the top light or lights for each cartridge 1 are illuminated, thus indicating proper installation.

Each cartridge 1 has a corresponding vertical light string 9 viewable by the user, the number of lights illuminated in the string 9 depending on the amount of ink present in the individual cartridge 1. Additional lights will become visible as more ink is used. When a particular ink cartridge 1 is empty, the supply light may then blink to indicate that the user should replace the particular cartridge 1.

In FIG. 4, a specific portion of a printer 8 is shown with the viewer window 7 and a horizontal row of six light strings 9, each of which corresponds to one of six different ink cartridges 1. Furthermore, each light string 9 has four lights that may be illuminated and displayed to the user. It is to be understood that the number of lights in a string 9 correspond to the number of reflection sites 4 in the corresponding cartridge 1. When fully lit, each of the individual lights together forms the vertical column or string 9 of lights. In the particular embodiment shown in FIG. 4, the top horizontal row of lights indicates, when lit, that the ink cartridges 1 are inserted correctly. It is to be understood that as the next light (descending from the top light) in a string 9 becomes illuminated, the ink supply within the corresponding cartridge 1 has depleted to a level that exposes a reflection site 4, thereby allowing the light from that reflection site 4 to be viewed by the user. As such, for the light strings 9 in which two, three, or four lights are illuminated, the ink in the cartridge 1 is becoming depleted and is, to some degree or another, getting nearer to empty. The extent of emptiness is gauged by the number of lights lit in the vertical string 9. In this embodiment, when the ink cartridges 1 are substantially empty, all of the lights in each of the six vertical light strings 9 are illuminated. When the ink cartridges 1 are substantially filled, no lights are shown, except for the top light of each column which indicates correct insertion.

FIG. 4 depicts one of various embodiments of the visual display in the viewer window 7 that may be provided to the user. It is to be understood that the thickness of the individual colored light strings 9 may be changed by varying the length or configuration of the reflection sites 4 in the individual ink cartridges 1. However, it is to be understood that in order to achieve the desirable reflecting properties, the angle (e.g., approximately 45°) at which the reflection site 4 is cut out from the prism 2 should remain within a desirable range in order to achieve a light beam from the prism 2 which accurately travels to the viewer window 7. For example, as long as the reflection site 4 is cut at the correct angle, thinner, vertical light strings 9 may be achieved by constructing reflection sites 4 having substantially horizontally narrower lengths, whereas thicker vertical light strings 9 may be accomplished by constructing horizontally thicker reflection sites 4. In this particular embodiment, even though primarily designed for a viewer's eye 20, the information on this display could also be registered by an electrical detection system (not shown in FIG. 4).

Figure 5A:
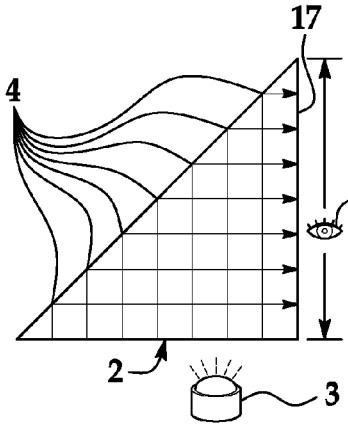
FIG. 5A depicts a semi-schematic side view of an embodiment of a prism.
Figure 5B:
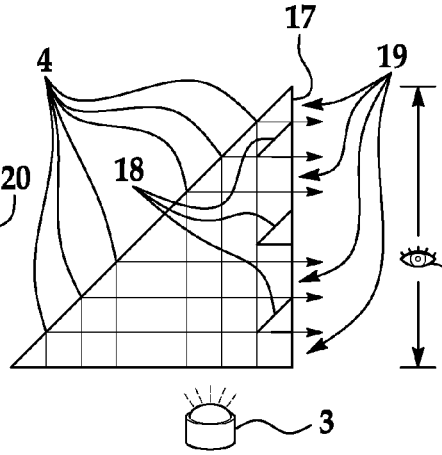
FIG. 5B depicts a semi-schematic side view of another embodiment of a prism.

Alternative visual displays may also be achieved by varying the geometry of the prism 2. FIGS. 5A and 5B illustrate two examples of such variations. Each of the embodiments shown respectively in FIGS. 5A and 5B, though visibly different than FIGS. 2A and 2B, provide 45° reflection sites 4 for the light beam coming from the LED 3 at the bottom of the prism 2. In the embodiment of FIG. 5A, the basic right triangular prism shape is maintained (since the entire hypotenuse side of the right triangular prism is at an angle of 45° with respect to the vertical pointing light beam from the LED 3). However, there are no cut-out portions in the prism 2 in FIG. 5A. Such an embodiment is able to reflect light beams to the viewing window 7 as indicated in FIG. 5A. It is to be understood that the intensity of the light in such an embodiment is normally not bright enough to be easily viewable by the user. In another embodiment of the prism 2 shown in FIG. 5B, there are a series of three jagged 45° cutouts 18 on the vertical wall 17 of the prism 2 facing the ink pocket 6 (shown in FIG. 5B). These cut-outs 18 do not serve as reflection sites 4, but rather as areas that actually reflect the light back into the prism 2. It is the uncut rectangular areas 19 in the vertical prism wall 17 directly above and below these cutouts 18 which enable the light to exit the prism 2 into the ink pocket 6. The light beamed from these rectangular areas 19 is the light that is actually perceived by the eye 20 or by an electronic detector 16 (see FIGS. 7A-7E). The light that is beamed from these areas 19 is beamed from reflection sites 4 in other areas of the prism 2.

Figure 5C:
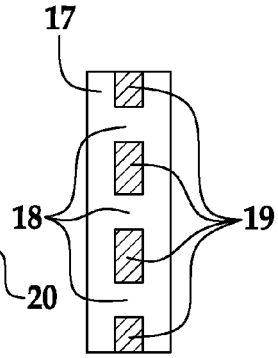
FIG. 5C depicts a semi-schematic front view of the prism of FIG. 5B.

FIG. 5C shows a front view of the prism 2 of FIG. 5B as it would be seen by the viewer. This user's view is actually the view of the prism wall 17 that faces the ink pocket 6. The cut-out areas 18 reflect no light signal, while the rectangular areas 19 above and below the cut-out areas 18 reflect the light signals.

Figure 6:
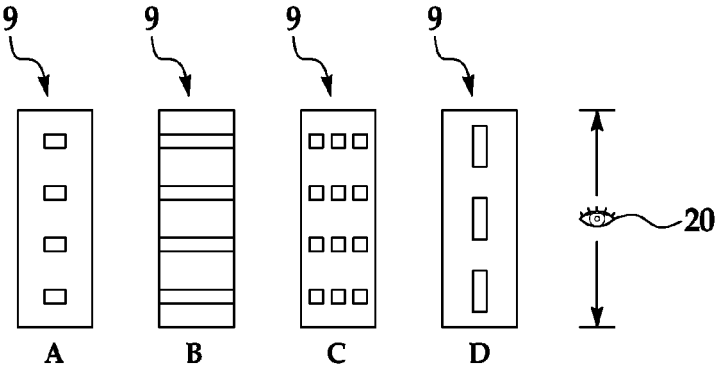
FIG. 6 semi-schematically depicts user-facing displays A, B, C and D from various different prisms according to an embodiment.

FIG. 6 depicts examples of alternative visual displays: A, B, C and D that may be achieved based on the geometry of the prism 2, and in particular on the shape of the reflection sites 4. For example, displays A and D in FIG. 6 illustrate how the lights in a light string 9 would look when the prism 2 is formed by making cut-outs 18 in the prism 2 which cause the light to reflect within the prism 2 and areas 19 which cause the light to reflect out of the vertical prism wall 17, similar to the embodiments shown in FIGS. 5B and 5C. Display D illustrates an embodiment in which the prism 2 has three reflection sites 4. Display B in FIG. 6 illustrates a series of horizontal light bands extending across the viewing window 7, which results from extending the reflection sites 4 horizontally across the entire side of the prism 2 that reflects the light from the LED 3 out the vertical prism wall 17 as a straight horizontal band. Display C in FIG. 6 shows gaps in the light bands, which may be formed by constructing intermittent portions horizontally across the reflection sites 4. In one embodiment, the intermittent portions are generally cut at an angle at which light will not reflect at 90° toward the vertical prism wall 17. In another embodiment, the reflection sites 4 include a non-reflective material at intermittent portions horizontally across the reflection sites 4. The effect of these intermittent portions is that the viewer sees a series of discrete portions of light positioned horizontally in relation to each other rather than in a solid horizontal band. Such embodiments are not intended to be limiting, but show some general techniques by which various kinds of visual light signals may be achieved.

FIGS. 7A, 7B, 7C, 7D and 7E show five slightly different embodiments of the ink cartridge 1 and prism 2, all of which employ a notch 11 or protrusion 11' either in the ink pocket-side of the prism wall 17, the opposite side 24 from the prism wall 17, or on the opposite side of the ink pocket 6 on the inner wall 5 of the ink cartridge 1. The notch 11 or protrusion 11' serves a light-interrupting function when ink fills all or part of the notch 11 or blocks the protrusion 11'.

While the LED 3 shown in FIGS. 7A through 7E is positioned to direct the light beam to one of the reflection sites 4, it is to be understood that the LED 3 may be positioned to direct light beams to each of the reflection sites 4 such that multiple light signals (some of which exit the cartridge 1 via wall 5 and others of which exit the cartridge 1 via the bottom 10) may be generated.

Figure 7A:
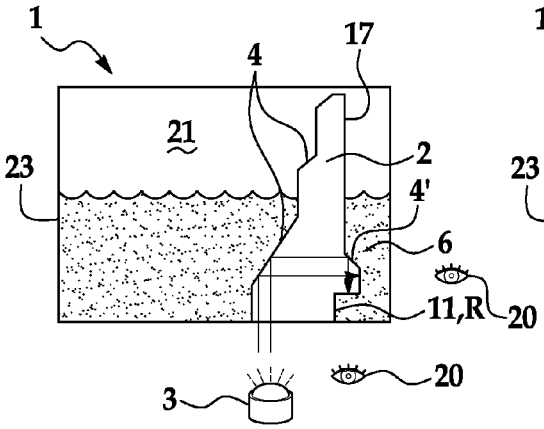
FIGS. 7A, 7B, 7C, 7D and 7E depict semi-schematic views of five different embodiments of an inkjet cartridge prism wall.
Figure 7B:
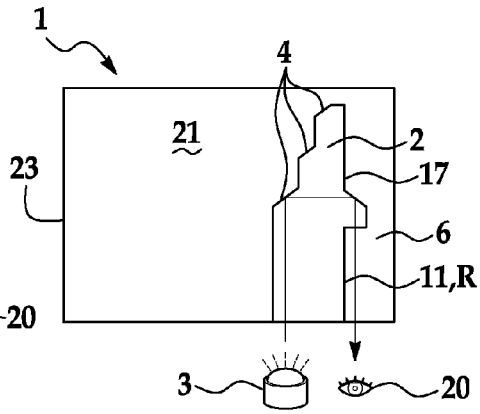
Figure 7C:
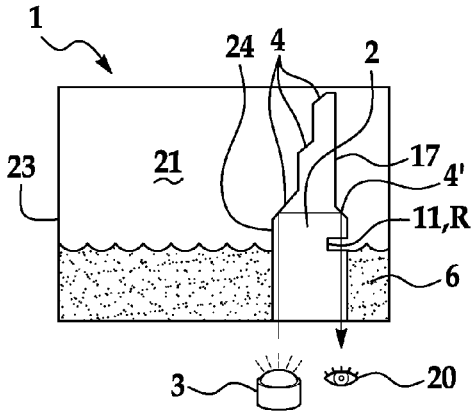
Figure 7D:
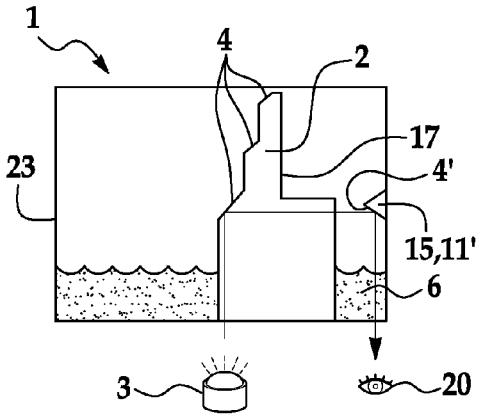
Figure 7E:
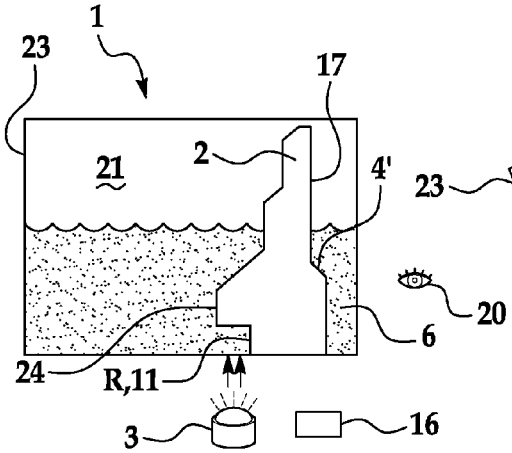

These embodiments include an additional reflection site 4', which directs the light toward the bottom 10 of the ink cartridge 1. In the embodiments of FIGS. 7A, 7B and 7C, a light beam from a reflection site 4 in the prism 2 is directed, via the additional reflection site 4', to the notch 11, which is cut out of a section of the prism wall 17. In the embodiment of FIG. 7D, the additional reflection site 4' directs the light down through the ink pocket 6. In the embodiment of FIG. 7E, the additional reflection site 4' directs the light down through the prism 2.

In the case of FIGS. 7A and 7B, the notch 11 extends all the way down the vertical prism wall 17 to the bottom 10 of the ink cartridge 1. These notches 11 form recesses R in the prism 2 which increases the volume of the ink pocket 6. In FIG. 7C, the notch 11 is cut out to extend part of the way down the vertical prism wall 17, thereby forming a smaller recess R than that shown in FIGS. 7A and 7B. It is to be understood that this smaller recess R also increases the ink pocket 6 volume somewhat. In FIG. 7D, the protrusion 11' is constructed by positioning an additional reflection site 4' on a piece of material 15 protruding from the wall 5 of the ink cartridge 1 that forms one side of the ink pocket 6. In FIG. 7E, a light beam directly from the light source 3 is directed to the notch 11, which is positioned between the reflection site 4 and the bottom 10 of the cartridge 1 along the wall 24 of the prism 2 opposed to the vertical prism wall 17. This notch 11 forms a recess R which increases the volume of the inner space 21. It is to be understood that when this notch 11 has ink therein, the light is blocked before it even enters the prism 2.

FIG. 7A shows an embodiment with the capability of having a horizontal light signal reflected across the ink pocket 6 and out of the ink cartridge 1 and a vertical light signal reflected down from a second reflection site 4' on the prism wall 17 and out the bottom 10 of the ink cartridge 1. It is to be understood that in the embodiment of FIG. 7A, since the ink pocket 6 and the notch 11 are filled with ink, the light signals are blocked from exiting the ink cartridge 1 at these particular points. However, it is to be understood that two separate light signals emitting from different parts of the ink cartridge 1 may be registered (when the ink level decreases such that blockage does not occur) by electrical detection, the human eye 20, or a combination of the two.

As previously stated, in FIGS. 7A and 7B, the notch 11 is cut out of the vertical prism wall 17 such that it extends to the bottom 10 of the ink cartridge 1. If there is any amount of ink in the ink pocket 6, it is likely to block the passage of light through the notch 11. As such, in FIG. 7A no light signals would be emitted from the ink cartridge 1 (except at those reflection sites 4 above the ink level), and in FIG. 7B, the light signal would be beamed out of the ink cartridge 1 from all the reflection sites 4 receiving light beams. The notches 11 of FIGS. 7A and 7B are different sized, but they achieve a similar result.

A variant embodiment of FIGS. 7A and 7B may be achieved by placing the notch 11 on the opposite wall 24 of the prism 2 from the vertical prism wall 17, as shown in FIG. 7E. As previously stated, if the light source 3 is positioned directly beneath the notch 11, the light signal will be detected when there is very little, if any, ink left in the ink cartridge 1, as the ink is in the position to block the light from entering the prism 2. The embodiment of FIG. 7E, like that of FIG. 7A, also includes the capability of having both a horizontal light signal reflected across the ink pocket 6 and out the side 5 of the ink cartridge 1, and a vertical light signal reflected down from the second reflection site 4' on the vertical prism wall 17 and out the bottom 10 of the ink cartridge 1.

Referring now to FIG. 7D, the notch 11 is formed such that it protrudes from the inner wall 5 of the cartridge 1. In this embodiment, the notch 11 includes a second reflection site 4' that receives the redirected light from the reflection site 4. The second reflection site 4' directs the light all the way down through the ink pocket 6 (when the ink level is such that light is able to pass) to the bottom 10 of the cartridge 1. As with the embodiments of FIGS. 7A and 7B, the embodiment of FIG. 7D is designed such that if there is any amount of ink in the ink pocket 6 it is likely to block the passage of light through the cartridge 1, thereby preventing a light signal from reaching either an electrical detector 16 or the eye 20 of a user.

The notch 11 in FIG. 7C (unlike that shown in FIG. 7B) does not extend all the way down the vertical prism wall 17, but is configured to extend a short way down the wall 17. The result is that the light (reflecting from both reflecting sites 4, 4') is beamed through the notch 11 when no ink is present in the notch 11. After passing through the notch 11, the light beam reenters the prism 2 at the bottom side of the notch 11 and travels down the prism 2 to the bottom 10 of the ink cartridge 1 as a light signal to be detected by an electrical detector 16 or viewed by the eye 20 of a user. This smaller notch 11 of FIG. 7C generates a light signal earlier than the notches 11 of FIGS. 7A, 7B and 7D, at least in part because ink will still be present in the ink pocket 6 (through which the light signals of FIGS. 7A, 7B and 7D travel) and the ink cartridge 1 as a whole, when the smaller notch 11 becomes empty.

Figure 8:
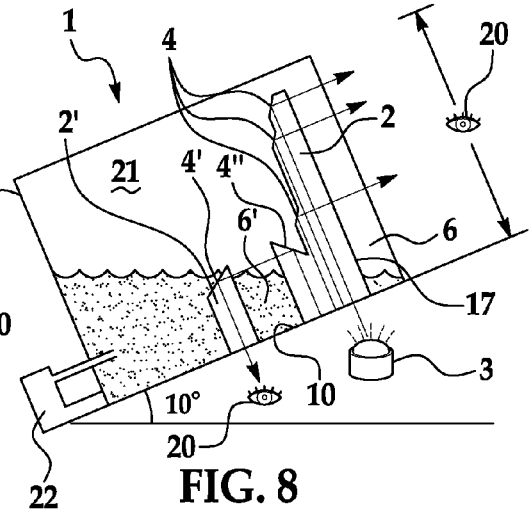
FIG. 8 depicts a semi-schematic view of still another embodiment of an ink cartridge including two prisms.

The embodiment of the ink cartridge 1 shown in FIG. 8 exemplifies two different aspects that can be employed either together or separately. In the first aspect, FIG. 8 shows an embodiment in which the ink cartridge 1 is tilted to create a situation in which the ink in the ink cartridge 1 accumulates in one end (opposed to the end in which the ink pocket 6 is formed) of the ink cartridge 1. This results in the ink pocket 6 running low on ink sooner than the area at the opposite side of the ink cartridge 1. This opposite side is generally the area of the ink cartridge 1 from which ink is dispensed to the printer 8. Such positioning results in the ink level detection function being triggered to show a low level of ink even when a certain amount of ink still remains in the ink cartridge 1. Thus, the user is alerted before the ink cartridge 1 is completely empty of the need to prepare to replace the old cartridge with a new cartridge.

In the second of the two different aspects, FIG. 8 shows the use of two separate optical prisms 2, 2' in an ink cartridge 1, the prism 2 on the right being that previously described, and the prism 2' on the left forming a second reflective site 4' for at least one of the light signals. The prism 2 forms the ink pocket 6 with the inner wall 5 and has reflection sites 4 consisting of 45° cutouts on the side of the prism 2 opposite the ink pocket 6. This embodiment of the prism 2 is notable for having, in addition to the previously mentioned reflection sites 4, one reflection site 4" that is a 45° cutout which reflects the vertical light beam from the LED 3 in the opposite direction of the other reflection sites 4. More particularly, this reflection site 4" directs a light beam in a direction (i.e., perpendicular to the original light beam) away from the ink pocket 6 and toward the second prism 2', which, in this embodiment, is positioned to the left of the first prism 2.

The second optical prism 2' to the left of the first prism 2 is generally smaller than the first prism 2 and forms a second ink pocket 6' with the first prism 2. The second prism 2' may be positioned anywhere along the bottom 10 between the prism 2 and the end of the cartridge 1 opposed to the ink pocket 6. It is to be understood that lower levels of ink may be detected the closer the second prism 2' is located to the dispenser 22. The second prism 2' has at least one 45° cut-out which forms a second reflection site 4' that receives a light beam from the reflection site 4" of first prism 2. The reflection site 4' on the second prism 2' then reflects the light beam so that the light travels directly down to the bottom 10 of the ink cartridge 1 where it can be detected. When the level of ink in this second ink pocket 6' is high enough to block the light beam from traveling through the second ink pocket 6' to the second prism 2', then no light signal is generated by the second ink prism 2'.

The aspect of FIG. 8 relating to the second prism 2' serves to provide a system whereby different ink levels in the ink cartridge 1 can be detected at different locations in each prism 2, 2'. Because ink is depleted sooner from the first ink pocket 6 than from the second ink pocket 6', the light beams generated by the first prism 2 and directed out the ink cartridge wall 5 through the first ink pocket 6 are detectable sooner than the light beam transmitted from the first prism 2 to the second prism 2' and out the bottom 10 of the ink cartridge 1. When this two prism 2, 2' arrangement is combined with the slanted position aspect of the ink cartridge 1 as shown in FIG. 8, even the light signal from the second prism 2' is generated before the ink in the ink cartridge 1 is completely depleted. The non-limiting embodiment combining both of these aspects may be used in a system employing both visual light signals (e.g., the light signals beamed out the ink cartridge wall 5 from the first prism 2) and electrically detectable light signals (e.g., the light signals beamed from the first prism 2 to the second prism 2' and down through the bottom 10 of the ink cartridge 1). It is to be understood that any configuration of detection may be used in such an embodiment, for example, all of the light signals may be viewable by the user, or the light signals from the first prism 2 may be electrically detectable while the light signals from the second prism 2' may be viewable by the user.

Furthermore, like FIGS. 7A and 7E, FIG. 8 also has the aspect of having light signals exiting from both the side 5 of the ink cartridge 1 and the bottom 10 of the ink cartridge 1. Thus again, two separate light signals emitting from different areas of the ink cartridge 1 can be registered by either electrical detection, the human eye 20 or a combination of the two.

Figure 9:
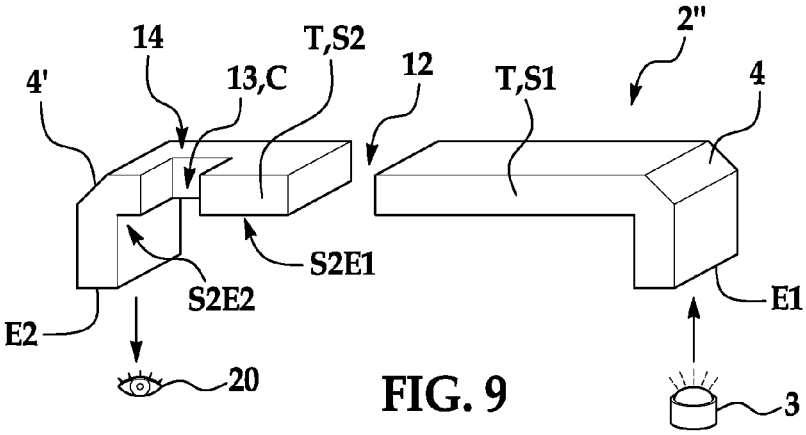
FIG. 9 depicts a semi-schematic perspective view of an embodiment of a "U"-shaped prism.

Referring now to FIG. 9, another embodiment of a prism 2" is shown as a squared-off "U" shape, with the two ends E1, E2 of the "U" configured to be positioned on the bottom 10 (not shown in this Figure) of the ink cartridge 1. The light source 3 generates a light beam which enters the prism 2" from one of the ends E1 and travels up one side of the "U" to a first reflection site 4, which is a 45° cut-out at the first perpendicular turn of the "U" shaped prism 2". This first reflection site 4 reflects the light 90° such that it travels straight across the top side T of the upside down "U" shaped prism 2". Along the way across the top side T of the prism 2", the light beam reaches a channel 12 which essentially forms a complete three-dimensional space or cut-out in the top side T of the "U". The light traveling from the first reflection site 4 exits one section of the prism 2" and travels across the channel 12 to where the top side T of the prism 2" resumes at the other side of the channel 12. The top side T of the prism 2" is therefore divided into two separate sections S1, S2, one of the sections S1, S2 being the portion before the channel 12 and the other of the sections S2, S1 being the portion after the channel 12. It is to be understood that the two sections S1, S2 are discontinuous, but are optically aligned. As such, if the channel 12 is not substantially filled with ink, the light beam can easily pass through the channel 12 and resume traveling through the second section S2 of the top side T of the prism 2".

In the second section S2 of the prism 2" a spaced distance from the channel 12, there is a notch 13 (forming another channel C) which unlike the channel 12, does not form a complete three dimensional space dividing the prism 2". Rather, the notch 13, C is a cut-out which extends approximately half-way into the width of the top side T and half-way across the light pathway through the top side T. As such, the notch 13, C divides a portion of the second section S2 into two opposed ends S2E1, S2E2. Therefore, approximately half of the light beam, which had previously traveled through the channel 12 (in the absence of ink), is able to travel through the portion 14 of the top side T, S2 directly adjacent the notch 13, C with no interruption. The other half of the light beam is able to pass through the second section first opposed end S2E1 and then through the notch 13, C if ink is absent from the notch 13, C. It is to be understood that the light beam then passes through the second section second opposed end S2E2. Thus, the light beam functions as a half-signal when the notch 13, C is blocked by ink, and functions as a full signal when the notch 13, C is not blocked by ink.

After passing through the notch 13, C and/or portion 14, the light then encounters another reflection site 4' formed by a 45° cut-out at the second perpendicular turn of the "U" shaped prism 2". This second reflection site 4' reflects the light 90°, thereby directing the light downward in a third side of the "U" shaped prism 2" and toward the ink cartridge bottom 10. The light beam exits the ink cartridge 1 as a light signal to be detected electrically and/or by the eye 20. In order to assure that this second reflection site 4' reflects the light downward to be detected, whether or not the ink level is at or above the reflection site 4', the reflection site 4' is designed to have a permanent air pocket (not shown) around it. Formation of the air pocket may be accomplished by providing an extra layer of the material of the prism 2", such as glass or polymeric material, around the reflection site 4'. This extra layer is positioned such that an air space exists between it and the second reflection site 4'. The air pocket assures that the second reflection site 4' on the third side of the "U" always reflects the light downward to be detected.

Figure 10:
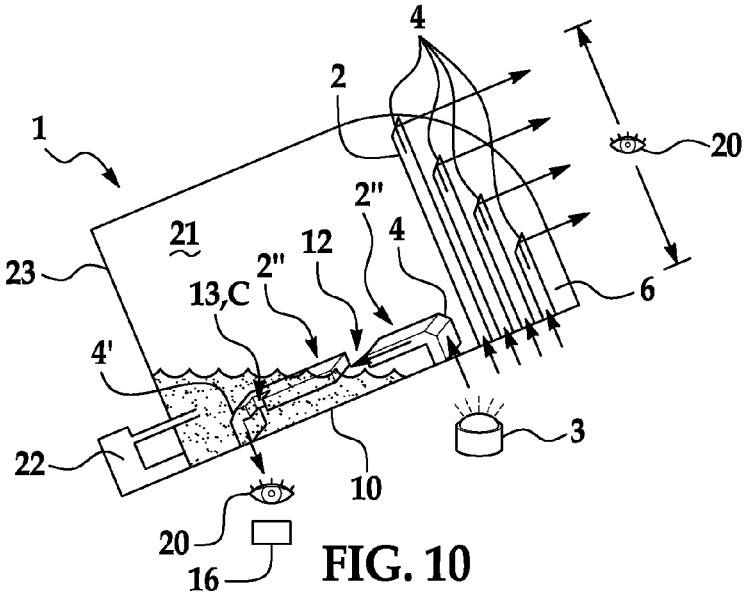
FIG. 10 depicts a semi-schematic perspective view of the "U"-shaped prism of FIG. 9 in an embodiment of the ink cartridge.

In FIG. 10, the "U" shaped prism 2" of FIG. 9 is shown positioned in an embodiment of the ink cartridge 1. This two-sectioned prism 2" has a light signal generated from and that is detectable through the bottom 10 of the ink cartridge 1. In the embodiment shown in FIG. 10, ink is blocking the notch 13, C. This results in a weaker light signal being detected, because the portion of the light beam traveling through the portion 14 of the top side T, S2 is detected, while the portion of the light beam encountering the filled notch 13, C is blocked from further travel, and thus is not detected.

The embodiment of FIG. 10 also includes a series of four optical prisms 2 graduated in height positioned to the right of the "U" shaped prism 2". Each of these optical prisms 2 has a 45° reflection site 4 at the top of each prism 2, where each reflection site 4 is located at a different height from the bottom 10 of the cartridge 1. When the ink level in the ink pocket 6 is below the respective reflection sites 2, four separate light beams are transmitted across the ink pocket 6 to the right wall 5 of the ink cartridge 1. As previously described, each light beam becomes active (i.e., is not blocked) when the ink in the ink pocket 6 is depleted to a level below the particular reflection site 4.

As shown in FIG. 10, the ink cartridge 1 is in a slanted position. In FIG. 10, the slant angle is approximately 10°, but it is to be understood that this is not a limiting aspect. In this non-limiting embodiment, the reflecting sites 4 of the four separate prisms 2 generate light signals which are beamed to the ink cartridge wall 5, and viewed by the user's eye 20 or detected electrically, the tallest prism 2 generating the first detectable signal, the next tallest prism 2 generating the second detectable signal, and so forth. Due, at least in part, to the slanted position of the cartridge 1, by the time the fourth prism 2 generates a detectable signal, the ink cartridge 1 is still approximately half full.

By the time the ink reaches a level such that a full detectable light signal is generated by the "U" shaped prism 2", the ink is much closer to empty. With the ink cartridge 1 in a slanted position, the channel 12 in the "U" shaped prism 2" becomes empty before the notch 13, C. As previously described, this results in a weaker signal, at least until the notch 13, C is emptied of ink. Like the embodiment of FIG. 9, the second reflection site 4' which receives and reflects the full or partial light beam may be surrounded by an air pocket (not shown) such that the light beam may be reflected even when the reflection site 4' is below the ink level. When the ink depletes to a level such that the light beam passes through the notch 13, C, a full signal is then generated. It is to be understood that when this last signal is detected by an electronic detector 16, a message may be generated by the printer 8 telling the user that the cartridge 1 is indeed close to empty.

Figure 11:
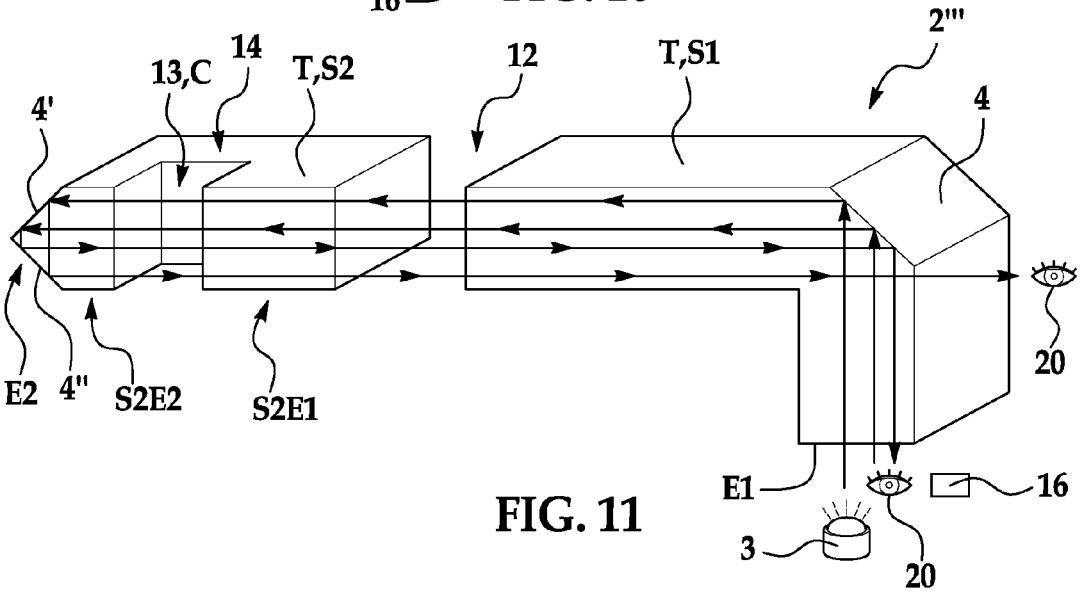
FIG. 11 depicts a semi-schematic perspective view of an embodiment of an "L" shaped prism.

FIG. 11 depicts still another embodiment of a two segmented prism 2'''. In FIG. 11, the two segmented prism 2''' includes the channel 12 (separating the top side T into segments S1, S2) and the notch 13, C (partially separating the second segment S2 into opposed ends S2E1, S2E2), but is "L"-shaped rather than "U"-shaped. The light is first directed through one end E1 of the prism 2''' at the short side of the "L", reflecting off a first reflection site 4 and traveling along the top or long side T of the "L" through the channel 12, notch 13, C, and portion 14 directly adjacent the notch 13, C, and to the other end E2 of the "L". The other end E2 of the prism 2''' includes two additional reflection sites 4', 4", one 4' of which reflects the light 90° toward the other 4". The other additional reflection site 4" then reflects the light 90° (i.e., 180° from the light beam reflected from the first reflection site 4) such that it travels back toward the reflection site 4.

Like the embodiments of FIGS. 9 and 10, the second and third reflection sites 4', 4" which receive and reflect the light beam are each surrounded by an air pocket (not shown) provided by an extra layer of material of the prism 2''' a spaced distance from and surrounding the additional reflection sites 4', 4", thus assuring that the reflection sites 4', 4" reflect any light beam they receive, regardless of the ink level. The light is beamed back through the notch 13, C and channel 12 toward the first reflection site 4. In one embodiment, the first reflection site 4 is configured to receive all of the reflected light and to reflect the received light 90° (if the reflection site 4 is above the ink level) toward the bottom 10 of the ink cartridge 1 at the end E1 at which the light first entered the prism 2'''. It is believed that this configuration of the prism 2''' is designed with space and energy considerations in mind, specifically so that the LED 3 and the electrical detector 16 or viewing window 7 can be located near each other.

In a further embodiment (shown in FIG. 11), the prism 2''' (and particularly the reflection site 4) may be configured so that the beam returning back through the top side T is broad enough such that a portion of the beam is reflected by the first reflector site 4, and another portion of the beam is not reflected down by the first reflector site 4. The portion not reflected passes directly through the prism wall 17 (i.e., when ink is not blocking that portion of the wall 17) and out of the ink cartridge inner wall 5 to a viewing window 7 where it can be viewed by a human eye 20. It is to be understood that this configuration enables the level of ink in the cartridge 1 to be both electrically detectable and human viewable at different areas around the cartridge 1, As such, the embodiments of FIGS. 10 and 11, like FIGS. 7A, 7E and 8, are capable of having a light signal (which is perpendicular to the original direction of the light beam and parallel to the bottom 10 of the ink cartridge 1) reflected across the ink pocket 6 and out the wall 5 of the ink cartridge 1, and another light signal (which is parallel to the original direction of the light beam and perpendicular to the bottom 10 of the ink cartridge 1 ) reflected out the bottom 10 of the ink cartridge 1. Thus again, two separate light signals may be registered by electrical detection, the human eye 20, or a combination of the two at two different areas of the ink cartridge 1.

While several embodiments have been described in detail, it will be apparent to those skilled in the art that the disclosed embodiments may be modified. Therefore, the foregoing description is to be considered exemplary rather than limiting.

What is claimed is:

1. An ink cartridge configured to hold an ink, the ink cartridge comprising:

a substantially hollow body including an inner space and a substantially continuous inner wall; and an optical prism in the inner space of the body, disposed at a predetermined distance from the continuous inner wall such that a prism wall and the continuous inner wall of the ink cartridge define an ink pocket, the optical prism including at least one reflection site formed at an angle configured to reflect light from a light source through the optical prism at a predetermined height of the optical prism relative to a bottom of the hollow body;

wherein, if the ink is present in the ink pocket at a level below at least a portion of the at least one reflection site, the ink does not block the light reflected off of the at least a portion of the at least one reflection site from traveling across the ink pocket at the predetermined height, such that the reflected light is externally viewable.

2. The ink cartridge of claim 1 wherein the light source is located outside the body.

3. The ink cartridge of claim 1 wherein the prism includes a plurality of separate reflection sites, each separate reflection site being located at a different predetermined height of the optical prism relative to the bottom, and wherein each separate reflection site generates a separate light reflection traveling through the optical prism and across the ink pocket at the predetermined height corresponding to the separate reflection site from which the separate light reflection is generated if the ink in the ink pocket does not block the separate light reflection from traveling at the corresponding predetermined height.

4. The ink cartridge of claim 3 wherein each of the separate light reflections at the corresponding predetermined height is externally viewable.

5. The ink cartridge of claim 4 wherein each of the separate light reflections at the corresponding predetermined height is externally viewable as a separate light signal.

6. The ink cartridge of claim 1, further comprising a plurality of separate reflection sites configured to reflect light at the predetermined height, wherein each of the separate reflection sites generates a separate light reflection traveling through the optical prism and across the ink pocket at the predetermined height in a different lateral position than each of the other separate light reflections traveling at the predetermined height if the ink in the ink pocket does not block the separate light reflections from traveling through the ink pocket at the predetermined height.

7. The ink cartridge of claim 6 wherein each of the separate light reflections traveling at the predetermined height is externally viewable.

8. The ink cartridge of claim 7 wherein the separate light reflections are externally viewable as separate light signals.

9. The ink cartridge of claim 1 wherein the body is positioned such that the ink does not block the at least one light reflection from traveling across the ink pocket at the predetermined height when at least a portion of the ink is still present in the body.

10. The ink cartridge of claim 1 wherein the continuous inner wall includes at least one additional reflection site on a portion thereof, the additional reflection site i) further defining the ink pocket, ii) positioned at the predetermined height, and iii) configured to receive and reflect the light reflected by the at least one reflection site of the optical prism if the ink in the ink pocket does not block the light reflected by the at least one reflection site from traveling across the ink pocket at the predetermined height.

11. The ink cartridge of claim 1, further comprising:

a second reflection site of the optical prism positioned at a second predetermined height that is different than the predetermined height;

a third reflection site of the optical prism configured to receive light reflected from the second reflection site; and a notch formed in the prism wall facing the ink pocket, the notch being cut out of an area of the prism completely crossing a light path that extends from the third reflection site to the bottom of the hollow body, thereby forming a recess in the optical prism which increases a volume of the ink pocket;

wherein the light travels on the light path from the third reflection site across the notch and out the bottom if ink is absent from the recess.

12. The ink cartridge of claim 1, further comprising a notch formed in a prism wall opposed to the prism wall facing the ink pocket, the notch being cut out of an area of the prism completely crossing a light path that extends from the bottom of the hollow body to the at least one reflection site, thereby forming a recess in the optical prism that increases the volume of the inner space, wherein light is prevented from entering the prism if ink is present in the recess.

13. The ink cartridge of claim 1 wherein the prism includes two discontinuous but optically aligned sections and a channel located between the two sections, and wherein, if the ink is absent from the channel, the light travels on a light path from a first of the two sections across the channel and into a second of the two sections.

14. The ink cartridge of claim 13 wherein the optical prism further includes a notch formed at an area of the prism partially crossing the light path in the second section such that the notch partially divides the second section into two opposed end regions, wherein the notch forms an other ink channel, and wherein, after the light travels on the light path from the first section across the channel and into a first opposed end region of the second section, a part of the light travels through the first opposed end region across the other ink channel and into a second opposed end region of the second section if ink is absent from the other channel.

15. The ink cartridge of claim 14 wherein the at least one reflection site is configured to direct the light through the channel and the other channel, and wherein the prism further includes at least two additional reflection sites, a first of the at least two additional reflection sites configured to i) receive the light after it passes through the channel and the other channel, and ii) transmit the light to a second of the at least two additional reflection sites, and the second of the at least two additional reflection sites configured to transmit the light back through the other channel and the channel to the at least one reflection site, which is configured such that i) a portion of the light that is reflected back contacts the at least one reflection site and is directed out the bottom of the hollow body, and ii) an other portion of the light that is reflected back does not contact the at least one reflection site and travels directly out the prism wall facing the ink pocket, thus dividing the light to form two detectable signals emitted from separate parts of the ink cartridge.

16. The ink cartridge of claim 1, further comprising a second optical prism positioned a spaced distance from a prism wall opposed to the prism wall facing the ink pocket, the second optical prism including:

a first section having a first reflection site;

a second section that is discontinuous from and optically aligned with the first section, the second section having a second reflection site configured to receive light reflected from the first reflection site and direct the light out of the bottom of the hollow body; and a channel located between the first and second seconds, wherein if the ink is absent from the channel, the light travels on the light path from the first section into the second section.

17. The ink cartridge of claim 1 wherein the optical prism includes two reflection sites, one at the predetermined height and an other at a second predetermined height, and wherein the ink cartridge further comprises an additional optical prism positioned adjacent to the optical prism to define a second ink pocket between the optical prism and the additional optical prism, the additional optical prism including at least one reflection site positioned at the second predetermined height of the other of the two reflection sites of the optical prism and configured to receive and reflect a light reflection generated by the other of the two reflection sites if the ink in the second ink pocket does not block the light reflection from traveling across the second ink pocket.

18. The ink cartridge of claim 17 wherein the at least one reflection site of the additional optical prism reflects the light down through the additional optical prism and out of the bottom of the hollow body.

19. A method of detecting a level of ink in an ink cartridge, the method comprising:

providing an ink cartridge including: i) a substantially hollow body including an inner space and a substantially continuous inner wall; and ii) an optical prism disposed in the inner space a predetermined distance from the continuous inner wall, thereby defining an ink pocket between the optical prism and the continuous inner wall;

beaming a light from a light source through the optical prism onto at least one reflection site formed at an angle configured to reflect the light received from the light source through the optical prism at a predetermined height of the optical prism relative to a bottom of the hollow body; and ascertaining whether the level of ink in the hollow body is below the predetermined height by visually detecting whether the light reflection passes from the optical prism across the ink pocket at the predetermined height and out to an external detector, wherein if the light reflection is not viewable, the light reflection is being blocked by ink present in the ink pocket at a level above the predetermined height.

20. The method of claim 19, wherein the optical prism further includes:

a second reflection site of the optical prism positioned at a second predetermined height that is different than the predetermined height;

a third reflection site of the optical prism configured to receive light reflected from the second reflection site; and a notch formed in the prism wall facing the ink pocket, the notch being cut out of an area of the prism completely crossing a light path that extends from the third reflection site to the bottom of the hollow body, thereby forming a recess in the optical prism which increases a volume of the ink pocket;

wherein the method further comprises ascertaining whether the ink level is substantially depleted by detecting, visually or electronically, a light signal traveling across the notch and out the bottom of the hollow body when ink is absent from the recess.

21. The method of claim 19, wherein the ink cartridge further includes an additional optical prism including:

a U-shaped hollow body having two opposed ends;

two reflection sites configured such that light enters one of the two opposed ends of the U-shaped hollow body and is directed through to exit an other of the two opposed ends of the U-shaped hollow body; and a channel separating the additional optical prism into two discontinuous but optically aligned sections;

wherein the method further comprises ascertaining whether the level of ink in the hollow body is below the channel by electronically detecting a light signal traveling through the additional optical prism when ink is absent from the ink channel.

22. The method of claim 19, wherein the optical prism includes two reflection sites, one at the predetermined height and an other at a second predetermined height, wherein the ink cartridge further includes an additional optical prism positioned adjacent to the optical prism to define a second ink pocket between the optical prism and the additional optical prism, the additional optical prism including at least one refection site positioned at the second predetermined height and configured to receive and reflect a light reflection transmitted by the other of the two reflection sites if the ink in the second ink pocket does not block the light reflection from traveling across the second ink pocket, and wherein the method further comprises ascertaining whether the level of ink in the hollow body is below the second predetermined height by detecting a light signal traveling through the additional optical prism when ink is below the second predetermined height.

* * * * *